US005671986A

United States Patent [19]

Vinet

[11] Patent Number: 5,671,986

[45] Date of Patent: Sep. 30, 1997

[54] DISHWASHER RACK SUPPORT ASSEMBLY

[76] Inventor: Pierre Vinet, 855 4th Avenue, P.A.T., Montreal, Quebec, Canada, H1B 4N5

[21] Appl. No.: 589,452

[22] Filed: Jan. 22, 1996

[51] Int. Cl.[6] ..... A47B 88/00

[52] U.S. Cl. ..... 312/334.8; 312/311; 312/334.21

[58] Field of Search ..... 312/311, 334.21, 312/334.39, 334.42, 334.18, 334.1, 334.5, 334.4, 334.7, 334.12, 334.8, 334.43; 211/181; 248/201, 200

[56] References Cited

U.S. PATENT DOCUMENTS

| | | | |
|---|---|---|---|
| 2,194,177 | 3/1940 | Rundell . | |
| 2,323,045 | 6/1943 | Jackson | 312/334.4 |
| 2,648,588 | 8/1953 | Ruspino . | |
| 2,869,961 | 1/1959 | Gomersall | 312/334.12 X |
| 3,044,842 | 7/1962 | Abresch et al. . | |
| 3,059,986 | 10/1962 | Miller, Jr. | 312/334.8 |
| 3,087,771 | 4/1963 | Pari . | |
| 3,441,331 | 4/1969 | Kesling . | |
| 3,486,804 | 12/1969 | Kaufman et al. | 312/311 X |
| 3,826,553 | 7/1974 | Cushing et al. | 312/311 X |
| 3,829,191 | 8/1974 | Jenkins . | |
| 3,834,783 | 9/1974 | Jenkins . | |
| 3,834,784 | 9/1974 | Butsch . | |
| 3,851,943 | 12/1974 | Afful . | |
| 4,147,393 | 4/1979 | Nelson et al. . | |
| 4,295,692 | 10/1981 | Jenkins . | |
| 4,359,250 | 11/1982 | Jenkins . | |
| 4,402,556 | 9/1983 | Schwnd . | |
| 4,437,715 | 3/1984 | Jenkins | 312/311 X |
| 4,449,765 | 5/1984 | Lampman | 312/311 |
| 4,681,381 | 7/1987 | Sevey . | |
| 4,810,045 | 3/1989 | Lautenschlager | 312/334.5 X |

FOREIGN PATENT DOCUMENTS

| | | | |
|---|---|---|---|
| 718629 | 3/1942 | Germany | 312/334.7 |
| 724102 | 2/1955 | United Kingdom | 312/334.8 |

*Primary Examiner*—Peter M. Cuomo
*Assistant Examiner*—Janet M. Wilkens

[57] ABSTRACT

A dishwashing machine of the from-loading type has a slidable support assembly enabling a dish supporting rack to be manually slid inwardly or outwardly through the access opening of the wash chamber of the machine. The assembly includes on each side of the rack an elongated channel slide member, a rack support member and two spaced apart bracket members. The elongated channel slide member supports the rack support member which is disposed to slidably move along the channel slide member so as to translate the load force of the rack to the channel slide member. Each bracket members is mounted to the wash chamber side wall and has a central body portion and upper and lower guiding flanges projecting towards the rack and converging toward each other to define a guideway surface for slidably supporting the channel slide member. Each bracket is secured to the side wall of the dishwashing machine by a post and one screw. The use of the bracket members provides a material cost savings and assembly time savings over the previous use of rollers mounted to the side walls.

12 Claims, 2 Drawing Sheets

DISHWASHER RACK SUPPORT ASSEMBLY

BACKGROUND OF THE INVENTION

The present invention relates to a dishwashing machine of the front-loading type having a slidable support assembly enabling a dish supporting rack to be manually slid inwardly or outwardly through the access opening of the wash chamber of the machine.

In domestic dishwashing machines of the front opening or front loading type it has become common for manufacturers to provide an upper dish supporting rack within the machine's wash chamber that is adapted to slide in a horizontal direction inwardly and outwardly through the front opening. In an outward position, the rack is disposed for loading of dishes therein to be washed. In an inward or retracted position, the rack is fully within the wash chamber so that the machine may be closed and placed into operation to perform its washing cycle.

The dishwasher rack is normally supported at each of its sides by a combination of rollers disposed to rotate about a horizontal axis and an elongated channel slide bar operatively associated with the rollers. Typically, this requires four rollers mounted to each side wall of the dishwasher by screws having threaded portions for securing the rollers to the side wall and non-threaded portions providing an axis about which the roller rotates. The channel slide bar is mounted between upper and lower spaced apart wall mounted rollers so that the slide bar can slidably move on these roller supports. Additional spaced apart rollers, journalled to the rack, project laterally from the rack and are captured within the channel area of the channel slide bar member. The journalled rollers slidably track in the channel slide bar member. The rack may then be manually drawn outwardly from its inward position in the wash chamber a limited distance wherein the rack rollers rotate and track along the length of the channel bar. When the rack has moved to where its forward roller contacts a stop at the end of the channel bar, the channel bar is then urged to move forward a limited distance until a stop provided at the end of the slide bar causes the slide bar to halt its forward movement. With the rack extending through the access opening of the machine's wash chamber in a cantilevered arrangement, the aforementioned action is reversed to slidably move the rack back to its retracted position within the wash chamber.

Quite commonly, the channel slide bar is formed from sheet metal of uniform thickness and is shaped to have a cross-section C-shape wherein the lengthwise opening to the inside channel area defined by the slide bar members faces inwardly toward the rack side to receive the rack journalled rollers. Such an arrangement is shown in U.S. Pat. No. 3,761,153 issued Sep. 25, 1973 to Lauren W. Guth and a similar arrangement is shown in U.S. Pat. No. 3,851,943 issued to Matthew K. Afful.

A major problem in the utilization of the foregoing arrangement is that the mounting of the rollers to the walls of the dishwasher requires a person to reach inside the dishwasher and screw in the four supporting screws for the four rollers on each side of the dishwasher. Next, during assembly, the rack must be slid past the rollers and the rear end stop snapped in place again requiring the person assembling the support to reach into the dishwasher. Simplification of this assembly would add savings in both material costs and labor.

SUMMARY OF THE INVENTION

In accordance with a broad aspect of the present invention there is provided a dishwashing machine of the front loading type having a wash chamber and an access opening thereto. The dishwashing machine includes a rack for supporting dishes to be washed slidably mounted in the chamber for movement between a loading position wherein the rack extends at least partially out through the access opening and a retracted position wherein the rack is fully within the chamber. The dishwashing machine includes a support assembly at each side of the rack including an elongated channel slide member, a rack support member and at least one bracket member. The elongated channel slide member has a major body portion and upper and lower projecting flange portions converging toward each other The rack support member is on the rack side and disposed to slidably move along the channel slide member so as to translate the load force of the rack to the channel slide member. The bracket member is mounted to the wash chamber side wall for slidably supporting the channel slide member. The bracket member has a central body portion and upper and lower guiding flanges projecting towards the rack and converging toward each other to define a guideway surface. The guideway surface is complementary to the outer surface of the channel slide member to permit sliding movement therein of the channel slide member and to prevent lateral movement of the channel slide member toward the wash chamber side wall.

Advantage is found with the present invention over the prior art described hereinabove since the bracket member of the present invention eliminates the use of rollers mounted to the side walls to support the channel slide member.

In the preferred embodiment the bracket member includes upper and lower wall mount support flanges for mounting the bracket member to the side wall. It is envisaged that the bracket member includes at least one mounting post projecting towards the side wall from at least one of the lower and upper wall mount support flanges. Further the bracket member includes at least one mounting screw opening in the upper wall mount support flange. Advantage is found by the use of a post as it reduces the number of screws required to secure the bracket which results in an assembly time savings.

It is envisaged that either the upper and lower guiding flanges or the channel slide member may be resilient permitting the channel slide member to be moved laterally and snapped into place relative to the bracket member during assembly. This is an advantageous assembly feature over the prior art since the end stop used in the back of the channel slide member can be inserted into the channel slide member prior to the slide member being assembled into wash chamber.

BRIEF DESCRIPTION OF THE DRAWINGS

For a better understanding of the nature and objects of the present invention reference may be had by way of example to the accompanying diagrammatic drawings.

DETAILED DESCRIPTION OF THE PREFERRED EMBODIMENT

Figure 1:
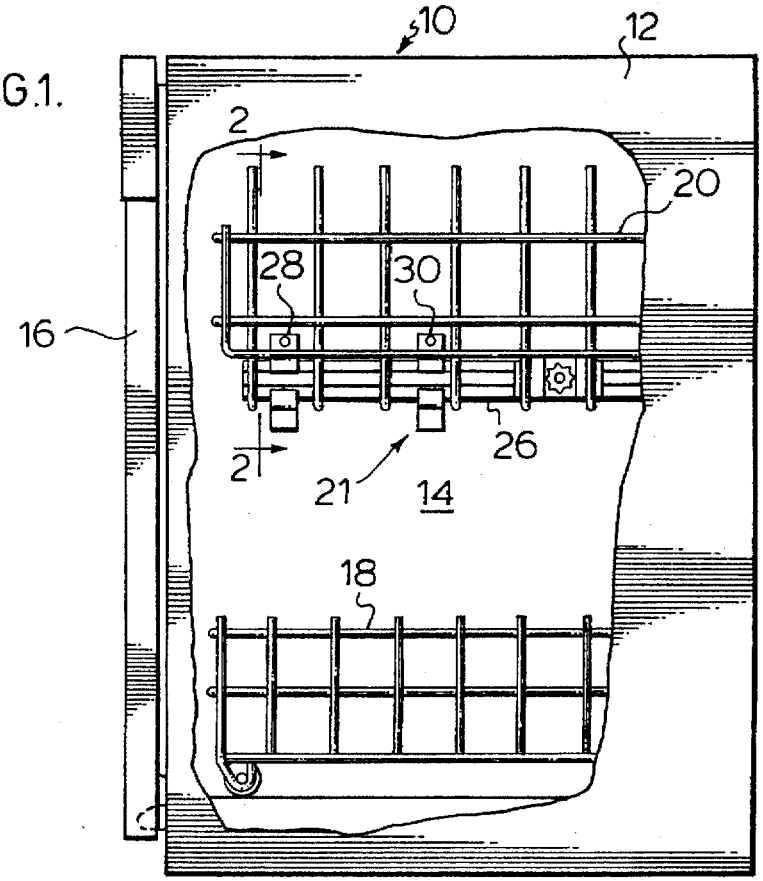
FIG. 1 is a fragmentary side elevational view of a dishwashing machine cabinet having the side wall thereof cut away to reveal dish supporting racks mounted within the wash chamber of the machine.

Referring to FIG. 1 there is shown an automatic dishwashing machine 10 having a cabinet 12 that defines an interior wash chamber 14. An access opening is provided on the front side of the cabinet 12 and is normally covered by a hinged access door 16. Contained within the wash chamber 14 are racks 18 and 20 for supporting dishes and other utensils to be washed in the machine 10.

Referring to FIGS. 1 to 4, a support assembly 21 supports the rack 20 at each side thereof relative to opposing wash chamber side walls 22 and 24. The support assembly 21 permits the rack 20 to be manually pulled outwardly from the wash chamber 14 to a loading position where it extends in a cantilevered manner over the open door 16. For simplicity, only one side of the support assembly is described.

The assembly 21 includes an elongated horizontally disposed channel slide member or slide bar 26 that functions to allow the rack 20 to be manually moved outwardly to its loading position and then retracted back to its operative position within the wash chamber 14. The channel slide member 26 is supported for sliding movement by two wall mounted bracket members 28 and 30. The channel slide member 26 comprises an intermediate body portion 32 and integral flange portions 34 and 36 that are inwardly inclined toward each other. The channel slide member 26 has a generally C-shaped cross-section.

Figure 2:
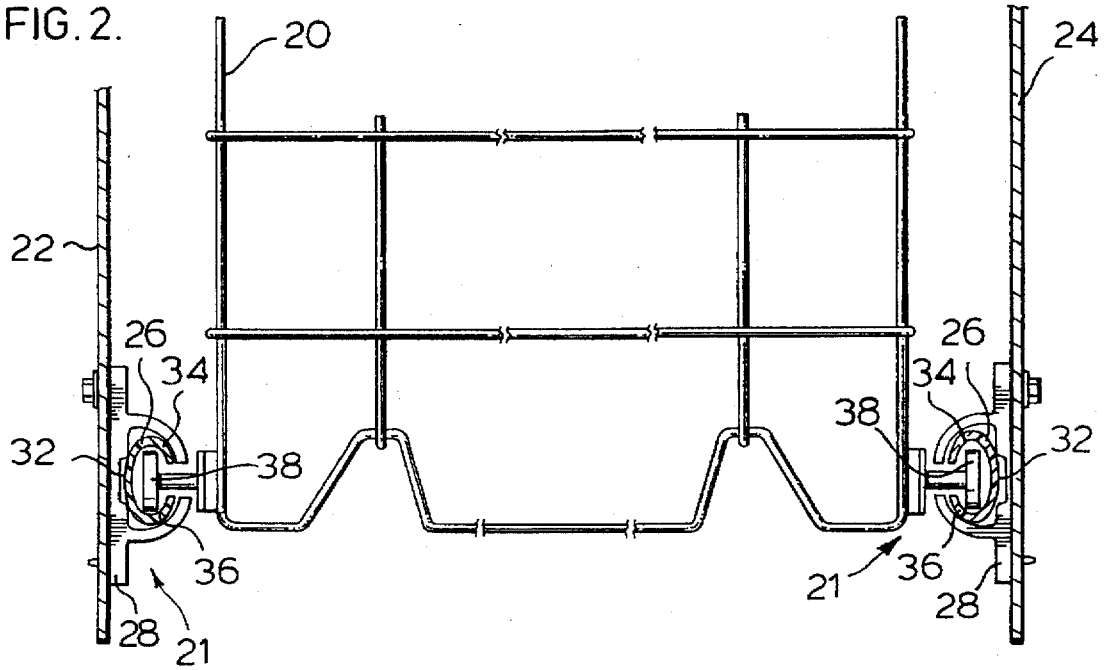
FIG. 2 is a vertical sectional view taken along line 2—2 of FIG. 1.
Figure 3:
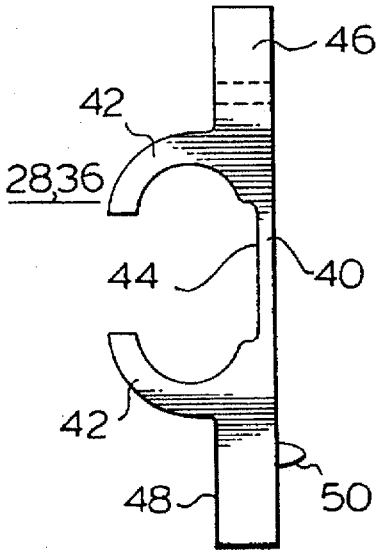
FIG. 3 is a side view of the bracket member, shown in an enlarged scale as compared to FIG. 2.
Figure 4:
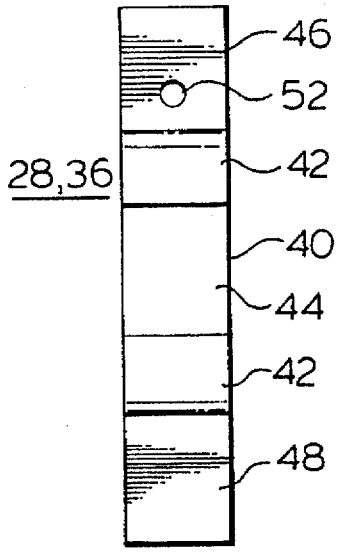
FIG. 4 is a front view of the preferred embodiment of the bracket member; and, FIG. 5 is a front perspective view of an alternate embodiment of the bracket member.

The assembly 21 further includes rack support members or roller 38 journalled to the side of the rack 20. Roller is captured for rotation within the channel slide member 26 as shown in FIG. 2. The rack journalled roller 38 is shaped to conform to the configuration of the channel slide member 26 to allow the roller 36 to slide relative to the channel slide member 26.

Each of the wall mounted bracket members 28 and 30 of the assembly 21 has a central body portion 40 and upper and lower guiding flanges 42. The guiding portions 42 project towards the rack 20 and converge toward each other to define a guideway surface 44. Guideway surface 44 is complementary to the outer surface of the channel slide member 26 so as to permit sliding movement therein of the channel slide member 26 and to prevent lateral movement of the channel slide member 26 toward the wash chamber side wall.

Each of the bracket members 28 and 30 includes upper and lower wall mount support flanges 46 and 48 for mounting the bracket member to the side wall. The bracket members 28 and 30 are mounted to the walls 22 and 24 of the wash tub chamber 14 by a mounting post 50 projecting out from the lower mounting flange 48 and a mounting screw adapted to pass through an access opening 52 in the upper mounting flange 46. The use of a post 50 assists in the location of the bracket relative the side wall during assembly and reduces the number of optimizes on the number of screws needed to locate the bracket resulting in a material cost savings.

The bracket 28 and 30 is preferably made from a plastic material which may permit for some give or resiliency in guide flanges 42. The channel slide member 26 comprises a metal which may have some resiliency. During assembly, the brackets 28 and 30 are first mounted to the wall, and one of the flange portions 34 or 36 of the channel slide member 26 is inserted into the guideway 44. Next the flange of the channel slide member remaining outside the guideway 44 is rotated toward the guideway and snapped into place past the bracket flanges 42. The snapping action is facilitated by the resiliency of either or, or both the guide flanges 42 and slide member 26. In this manner, the channel slide member can be said to be moved laterally and snapped into place. This is an advantageous assembly feature over the prior art since the end stop used in the back of the channel slide member to prevent the channel slide member from being pulled past the rear bracket 30 during operation, can be inserted into the channel slide member prior to the slide member being assembled into wash chamber.

Figure 5:
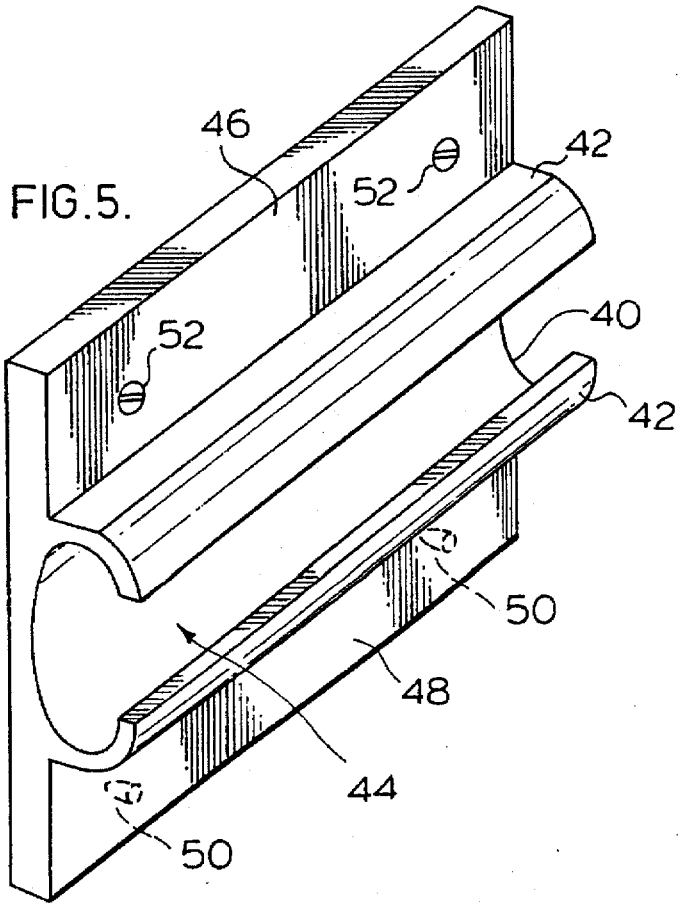

Referring to FIG. 5, there is shown an alternate embodiment for the bracket member of the present invention. In this embodiment, only one bracket member would be used with each side wall due to the relative elongated dimension of the bracket member.

It should be understood that a sliding clearance is preferably provided between each of the relatively moving parts of the assembly 21.

I claim:

1. A dishwashing machine of the front loading type having a wash chamber and an access opening thereto, comprising:

a rack for supporting dishes to be washed slidably mounted in the chamber for movement between a loading position wherein the rack extends at least partially out through the access opening and a retracted position wherein the rack is fully within the chamber;

a support assembly at each side of the rack including:

an elongated channel slide member having a major body portion and upper and lower projecting flange portions converging toward each other;

a rack support member on the rack side being disposed to slidably move along the channel slide member and to translate the load force of the rack to the channel slide member; and, at least one bracket member mounted to the wash chamber side wall for slidably supporting the channel slide member, the bracket member having a central body portion lying flush to the wash chamber side wall for mounting thereto, said bracket member having upper and lower guiding flanges projecting from the central body portion towards the rack and converging toward each other to define a guideway surface complementary to the outer surface of the channel slide member to permit sliding movement therein of the channel slide member and to prevent lateral movement of the channel slide member toward the wash chamber side wall, and the channel slide member being movable laterally and snapped into place relative to the bracket member during assembly.

2. The dishwashing machine of claim 1 wherein the bracket member includes upper and lower wall mount support flanges for mounting the bracket member to the side wall.

3. The dishwashing machine of claim 2 wherein the bracket member includes at least one mounting post projecting towards the side wall from at least one of the lower and upper wall mount support flanges.

4. The dishwashing machine of claim 2 wherein the bracket member includes at least one mounting screw opening in the upper wall mount support flange.

5. The dishwashing machine of claim 2 wherein channel slide member has a generally C-shaped cross-section and the guideway surface of the bracket member has a generally C-shaped cross-section.

6. The dishwashing machine of claim 1 wherein the upper and lower guiding flanges are resilient to permit the channel slide member to be moved laterally and snapped into place relative to the bracket member during assembly.

7. The dishwashing machine of claim 1 wherein the rack supporting member on the rack side comprises at least one roller journalled to the rack and captively contained within the inside area of the channel slide member for slidably tracking movement therein.

8. The dishwashing machine of claim 1 comprising two bracket members mounted on each side wall in spaced apart relation.

9. The dishwashing machine of claim 8 wherein each bracket member includes upper and lower wall mount support flanges for mounting the bracket member to the side wall.

10. The dishwashing machine of claim 9 wherein each bracket member includes at least one mounting post projecting from the lower wall mount support flange towards the side wall.

11. The dishwashing machine of claim 8 wherein the upper and lower projecting flange portions are resilient to permit the elongated channel member to be moved laterally and snapped into place relative to the bracket member during assembly.

12. The dishwashing machine of claim 8 wherein the rack supporting member on the rack side comprises at least one roller journalled to the rack and captively contained within the inside area of the channel slide member for slidably tracking movement therein.

* * * * *